US007348509B2

(12) United States Patent
Severson et al.

(10) Patent No.: US 7,348,509 B2
(45) Date of Patent: Mar. 25, 2008

(54) HIGH PRESSURE SWITCH WITH ISOLATED CONTACTS

(75) Inventors: Steve Severson, Pompano Beach, FL (US); Steve Veselaski, Jr., Pompano Beach, FL (US)

(73) Assignee: Micro Pneumatic Logic, Inc., Pompano Beach, FL (US)

( * ) Notice: Subject to any disclaimer, the term of this patent is extended or adjusted under 35 U.S.C. 154(b) by 10 days.

(21) Appl. No.: 11/393,148

(22) Filed: Mar. 29, 2006

(65) Prior Publication Data

US 2007/0235302 A1 Oct. 11, 2007

(51) Int. Cl.
*H01H 35/34* (2006.01)
*H01H 35/38* (2006.01)

(52) U.S. Cl. ..... 200/83 J; 200/83 P

(58) Field of Classification Search ..... 200/81 R, 200/82 R, 83 A, 83 R, 83 J, 83 N, 83 P, 200/83 S, 83 SA, 83 V; 73/715, 716
See application file for complete search history.

(56) References Cited

U.S. PATENT DOCUMENTS

| | | | | | |
|---|---|---|---|---|---|
| 3,617,665 | A | * | 11/1971 | Berson et al. | 200/83 P |
| 3,984,649 | A | * | 10/1976 | Bauer et al. | 200/83 SA |
| 4,004,272 | A | | 1/1977 | Claxton et al. | |
| 4,521,683 | A | | 6/1985 | Miller | |
| 4,581,941 | A | | 4/1986 | Obermann et al. | |
| 4,757,165 | A | * | 7/1988 | Marcoux et al. | 200/83 P |
| 4,820,890 | A | * | 4/1989 | Tamura et al. | 200/81.4 |
| 4,891,479 | A | * | 1/1990 | Davis | 200/81 R |
| 5,132,500 | A | | 7/1992 | Clew | |
| 5,461,208 | A | * | 10/1995 | McKenna | 200/83 J |
| 5,889,247 | A | * | 3/1999 | Homol | 200/83 P |
| 6,089,098 | A | | 7/2000 | Tylisz et al. | |
| 6,154,586 | A | | 11/2000 | MacDonald et al. | |
| 6,346,681 | B1 | * | 2/2002 | Joyce et al. | 200/83 S |
| 6,495,777 | B1 | * | 12/2002 | Chou | 200/83 R |
| 7,071,430 | B2 | * | 7/2006 | Farano et al. | 200/81.4 |

* cited by examiner

*Primary Examiner*—Elvin Enad
(74) *Attorney, Agent, or Firm*—Cooper & Dunham LLP

(57) ABSTRACT

A pressure switch employs electrical contacts isolated from pressure media. By employing a snap action blade in a snap over center configuration, it is possible to provide a hysteresis effect in which the switch actuates at one pressure and deactuates at a different pressure.

17 Claims, 3 Drawing Sheets

HIGH PRESSURE SWITCH WITH ISOLATED CONTACTS

TECHNICAL FIELD

This disclosure relates generally to a pressure switch and, more particularly, to a pressure switch that can be actuated by high pressure and in which the contacts are isolated from the pressure media.

BACKGROUND

A pressure switch is a type of switch in which the switching action is triggered by pressure in the surrounding environment. Pressure switches have been proposed for use in various kinds of electro-mechanical devices. The pressure detection mechanism in a typical pressure switch is a diaphragm configured in the pressure switch to be impinged upon by the pressure media (such as air or gas under pressure), and upon reaching a particular pressure the diaphragm is translated to cause the switch contacts of the pressure switch to be actuated.

However, conventional pressure switches tend to operate only at relatively low pressure levels (50-150 PSIG).

Another problem of conventional pressure switches is that they are not sufficiently miniaturized and they frequently occupy too much space in the electro-mechanical device.

SUMMARY

The present disclosure provides a pressure switch that can effectively avoid the above-noted disadvantages of conventional pressure switches.

In one example of this disclosure, a pressure switch with contacts that are isolated from the pressure media is provided.

In another example of the present disclosure, a pressure switch is provided in which the switch contacts are isolated from the pressure media and a snap actuation blade mechanism is provided to be actuated in response to the pressure.

By constructing the snap actuation blade mechanism in an exemplary configuration described and shown herein, it is possible to provide a hysteresis response in which the deactuation pressure level is different from the actuation pressure level.

BRIEF DESCRIPTION OF THE DRAWINGS

The features of the present disclosure can be more readily understood from the detailed description below with reference to the accompanying drawings wherein.

DETAILED DESCRIPTION

In describing examples and preferred embodiments in connection with the drawings, specific terminology is employed for the sake of clarity. However, the disclosure of this patent specification is not intended to be limited to the specific terminology so selected, and it is to be understood that each specific element includes all technical equivalents that operate in a similar manner.

An example of a pressure switch which avoids the disadvantages of convention pressure switches includes a pressure detection mechanism coupled to a contact driving mechanism, a first terminal, and a second terminal coupled to a snap action blade. The first terminal has a first contact attached thereto, and the snap action blade of the second terminal has a second contact coupled thereto. The second contact is normally (that is, when no force is being applied to the snap action blade) in electrical contact with the first contact. When the pressure detection mechanism detects a pressure media at or above an actuation pressure level, the pressure detection mechanism causes the contact driving mechanism to drive the snap action blade into a deflected position whereby the second contact becomes no longer in electrical contact with the first contact. An output of the switch through the terminals switches when the electrical contact between the first contact and the second contact is discontinued by the deflection of the snap action blade. The combination of the pressure detection mechanism and the contact driving mechanism isolates the pressure media from the remainder portions of the pressure switch, including in particular the snap action blade.

The pressure detection mechanism may be any of the known pressure detection devices. One example of a pressure detection mechanism is a diaphragm configured to detect pressure media through a pressure channel. The diaphragm may be mechanically coupled to a plunger assembly which actuates the snap action blade in response to force applied to the diaphragm.

Figure 1:
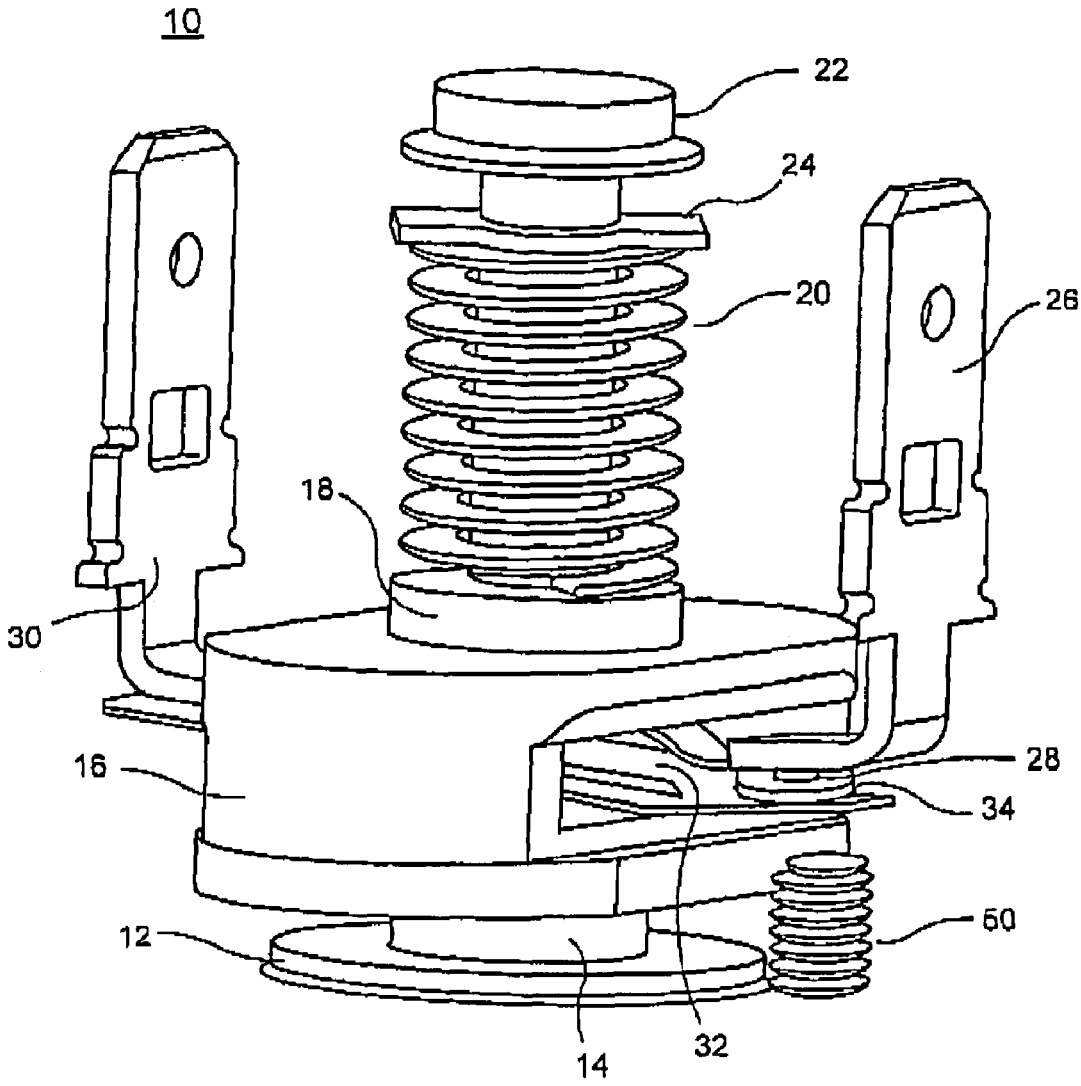
FIG. 1 is a front elevational view of a high-pressure miniature switch without covers according to an example of the present disclosure.

Such an example of a pressure switch 10 will be discussed with reference to FIG. 1. Electrical switching of the switch 10 occurs when a force is applied to a rubber diaphragm 12 which is coupled to a lower (or bottom) plunger portion 14. The plunger also includes an upper portion 18 complementary to the lower portion 14.

A first terminal 26 carries a fixed contact 28. A common terminal 30 has a snap action blade 32 attached thereto with a movable contact 34 attached thereto. The terminals 26 and 30 are securely held between upper plunger portion 18 and lower plunger portion 14. The moveable contact 34 is normally (that is, when little or no force is applied to the diaphragm) in a closed position such that it is in contact with the fixed contact 28.

Figure 2:
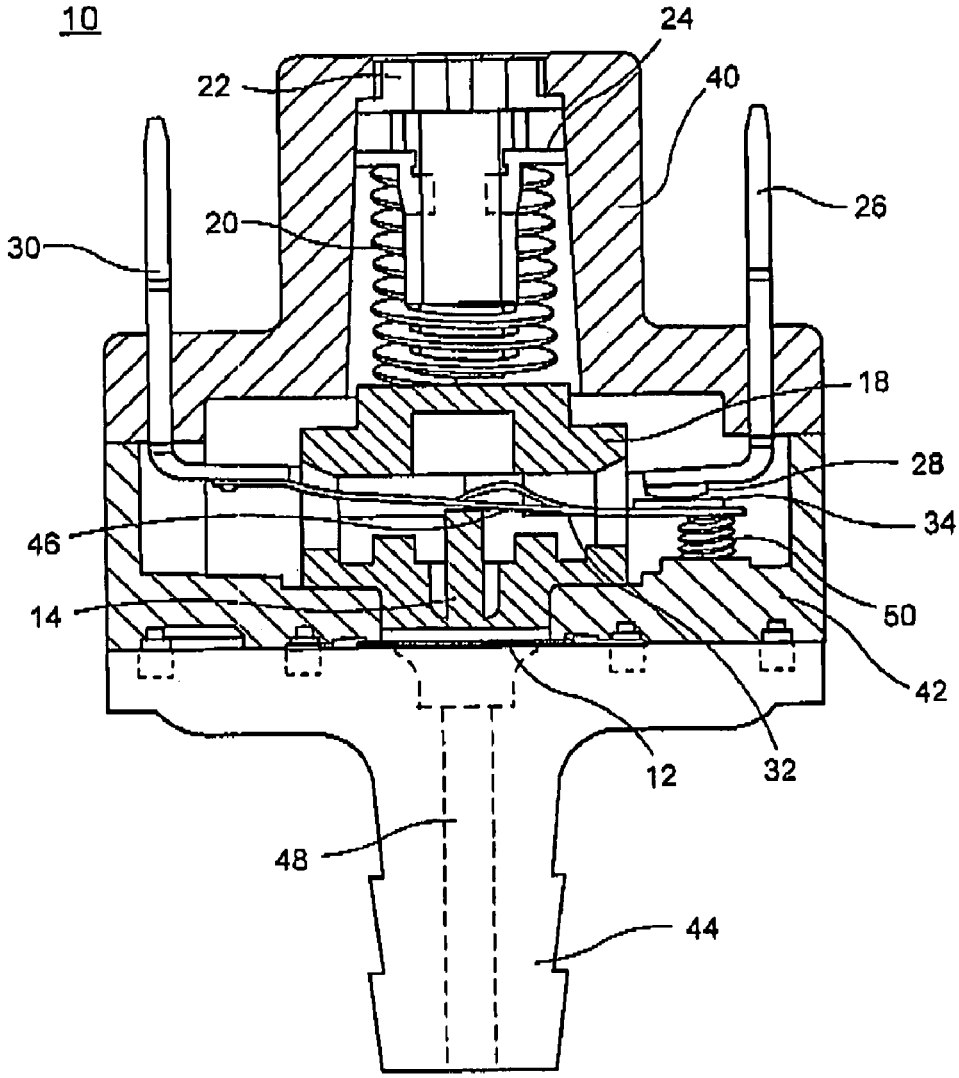
FIG. 2 is cross sectional view of a high-pressure miniature switch according to an example of the present disclosure.

FIG. 2 shows in a cross-sectional view an illustration of an example of operation of the combination of the contacts and the snap action blade. In FIG. 2, the pressure-actuated switch 10 is shown with its components installed in a casing (as it typically will be in operation). The casing includes an upper cover portion 40 arranged on a lower or base portion 42 of the casing. The diaphragm is held between the base portion 42 and a stem 44. The switch elements are protected from the pressure media by the casing, with the diaphragm portion 12 being exposed to the external environment via channel 48 in the stem 44 so that it may be subjected to applied force from the pressure medium. The diaphragm in the example of FIG. 2 is installed in the lower base portion 42 in a plate-like element which forms a cover for the bottom of the case.

As seen in FIG. 2, the movable contact 34 mounted on the snap action blade 32 is in contact with the fixed or normally closed contact 28 that is connected to the terminal 26.

A spring 20 is preferably included to abut an upper surface of the upper plunger portion 18. The spring 20 provides a spring force against the plunger that is controlled by a threaded screw 22. The threaded screw 22 may be adjusted by use of a nut 24 threaded onto the screw 22 such that the spring force is increased or decreased depending on the desired pressure at which the pressure switch 10 is to respond.

The screw 22 in the example of FIG. 2 is a socket head cap screw that is threadedly engaged in the nut 24 and is captured in the upper cover portion 40. Upon turning the screw 22, the force of spring 20 on the upper (or top) plunger portion 18 is changed, which in turn changes the amount of force needed to be exerted on the diaphragm 12 and thereby on the lower (or bottom) plunger portion 14 to cause the snap action blade 32 to change position. In the operations of the switch shown in FIGS. 1 and 2, when the deforming force of the rubber diaphragm 12 causes the snap action blade 32 to deflect, electrical switching occurs in a circuit connected to terminals 26 and 30. The snap action blade mechanism configured as shown in FIG. 2 is called a "snap over center" mechanism. The snap over center mechanism creates a concave-convex portion on the snap action blade, allowing the snap action blade to deflect when force from diaphragm 12 is applied to the snap action blade. By putting the pivot point, shown generally at 46 in FIG. 2, off center, the snap action blade results in a pressure hysteresis response. That is, the actuation pressure level at or above which the switch actuates differs from the deactuation pressure level at or below which the switch deactuates by the value of the pressure hysteresis. Adjusting screw 50 can be used to change the pressure hysteresis response value by adjusting the stopping point for the snap over center mechanism.

When an optional spring assembly is provided, the pressure level at which the switch actuates can be controlled by adjusting the screw 22 to change the bias force of the compressive spring 20. The bias force is translated through the upper (or top) plunger portion 18 to preload the snap action blade 32, thereby establishing the threshold pressure at which the switch actuates.

The diaphragm 12 expands in response to applied force from the external pressure and acts in response to such pressure to drive the lower plunger portion 44 towards the snap action blade 32. The diaphragm, after being installed in the housing formed by the base 42 and the stem 44, is retained within the housing such that the diaphragm 12 is positively captured.

Figure 3:
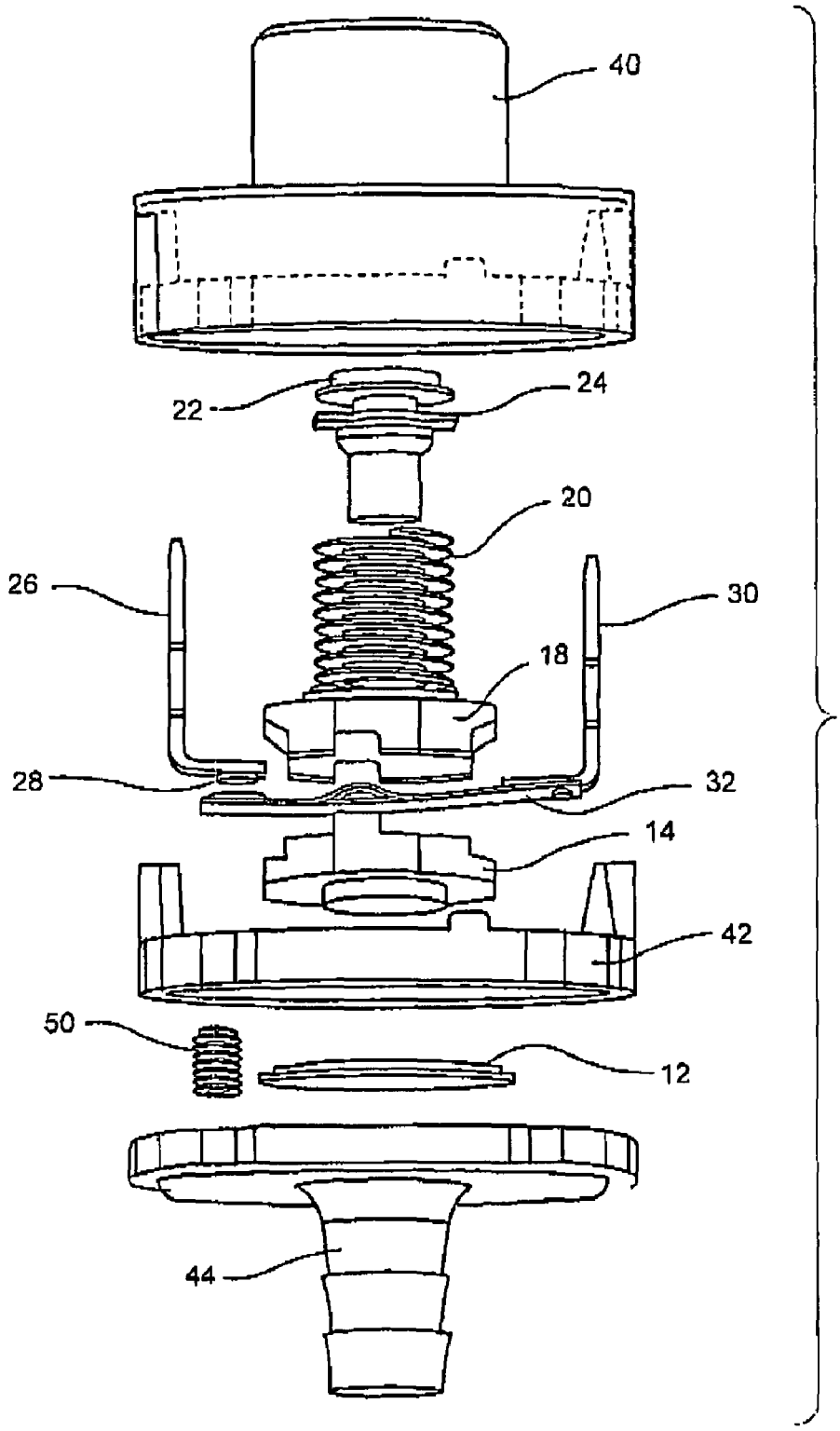
FIG. 3 is an exploded view of a high-pressure miniature switch according to an example of the present disclosure.

FIG. 3 shows the switch assembly including housings in an exploded view. The fixed contact 28 fits into a suitable aperture (not shown) in the first terminal 26. In addition, the snap action blade 32 is captured between the upper (or top) plunger portion 18 and the lower (or bottom) plunger portion 14, and is actuated by the flexing of the diaphragm 12. The lower base 42 and the stem 44 are held together by fasteners (not shown) to form the housing.

A high pressure switch according to this disclosure has many uses. For example, it can be used in an air compressor to shut-off the compressor motor when a maximum tank pressure is achieved and to start the compressor motor once the tank pressure falls below a predetermined level. In that regard, a high pressure switch having a construction similar to that described herein can be configured for switching action in the range of 50 PSIG to 200 PSIG. By suitably arranging the snap action blade, the differential between the actuation point and the deactuation point can be set to be approximately 25 to 30 PSIG. Furthermore, by providing a switch in which the contacts can be quite robust (such as provided in the present disclosure), the switch can switch between 15 and 20 amperes. The switch can be configured in a preferred embodiment as a miniature (or micro) high pressure switch, for example, dimensioned at approximately 1.5" OAL and 1.5" diameter.

The above specific examples and embodiments are illustrative, and many variations can be introduced on these embodiments without departing from the spirit of the disclosure or from the scope of the appended claims. For example, elements and/or features of different illustrative embodiments may be combined with each other and/or substituted for each other within the scope of this disclosure and appended claims.

What is claimed is:

1. A pressure switch comprising:

a diaphragm;

a plunger coupled to said diaphragm, wherein said plunger is driven when a force of a pressure media is applied to said diaphragm;

a first terminal with a fixed contact;

a second terminal coupled to a snap action blade with a movable contact coupled thereto; and a spring abutting on an inner surface of said plunger, wherein said spring applies a spring force against said plunger, and wherein when said snap action blade is a quiescent position in which said plunger is not driven, said fixed contact of said first terminal is in electrical contact with said movable contact of said second terminal, and upon depression of said plunger, said snap action blade deflects to a deflected position whereby the movable contact is not in electrical contact with the fixed contact and an output of said switch through said terminals switches when said fixed and moveable contacts separate due to deflection by said snap action blade.

2. The pressure switch of claim 1, wherein the snap action blade is configured in a snap-over-center configuration.

3. The pressure switch of claim 1, wherein the switch deactuates at a first pressure at or above a deactuation level and actuates a second pressure at or below an activation level different from said deactivation level.

4. The pressure switch of claim 3, wherein said activation level is lower than said deactivation level.

5. The pressure switch of claim 3, wherein a differential between said actuation level and said deactivation level can be set in a range of 25 to 30 PSIG by appropriately arranging the snap action blade.

6. The pressure switch of claim 3, wherein said deactuation level is in a range of 50 PSIG to 200 PSIG.

7. The pressure switch of claim 3, further comprising a compression spring coupling a screw-and-nut mechanism to said plunger, wherein said deactuation level is adjustable by operating said screw-and-nut mechanism to change a spring force of said compression spring.

8. The pressure switch of claim 1, wherein said pressure switch is a miniature switch.

9. The pressure switch of claim 1, wherein said switch is dimensional at approximately 1.5" OAL and 1.5" diameter.

10. The pressure switch of claim 1, wherein said snap action blade is deflected when a pressure of said pressure media is at or above an deactuation level in the range of 50 PSIG to 200 PSIG.

11. The pressure switch of claim 1 wherein said spring force is adjustable by operating a threaded screw.

12. A pressure switch comprising:

a first terminal with a first contact;

a second terminal coupled to a snap action blade with a second contact coupled thereto, said second contact being in electrical contact with said first contact when no force is applied to said snap action blade;

a pressure detection mechanism;

a plunger coupled to said pressure detection mechanism; and a spring abutting on an inner surface of said plunger, wherein said spring applies a spring force against said plunger;

wherein when said pressure detection mechanism detects a pressure media at or above a deactuation pressure level, said pressure detection mechanism triggers said plunger to drive said snap action blade into a deflected position whereby said second contact is not in said electrical contact with said first contact, and an output of said switch through said terminals switches when said electrical contact is discontinued by the deflection of said snap action blade.

13. The pressure switch of claim 12, wherein a combination of the pressure detection mechanism and the contact driving mechanism separates the pressure media from the snap action blade.

14. The pressure switch of claim 12, wherein the snap action blade is configured in a snap-over-center configuration.

15. The pressure switch of claim 12, wherein the switch deactuates at a first pressure at or above said deactuation level and actuates at a second pressure at or below an activation level different from said deactivation level.

16. The pressure switch of claim 15, wherein said activation level is lower than said deactivation level.

17. The pressure switch of claim 12, wherein said snap action blade is deflected when a pressure of said pressure media is at or above said deactuation level in the range of 50 PSIG to 200 PSIG.

* * * * *